US010139141B2

(12) United States Patent
Andersson et al.

(10) Patent No.: US 10,139,141 B2
(45) Date of Patent: Nov. 27, 2018

(54) COMBINED CONDENSOR AND EVAPORATOR

(71) Applicant: SWEP INTERNATIONAL AB, Landskrona (SE)

(72) Inventors: Sven Andersson, Hassleholm (SE); Tomas Dahlberg, Helsingborg (SE)

(73) Assignee: SWEP INTERNATIONAL AB, Landskrona (SE)

( * ) Notice: Subject to any disclaimer, the term of this patent is extended or adjusted under 35 U.S.C. 154(b) by 646 days.

(21) Appl. No.: 14/764,510

(22) PCT Filed: Feb. 14, 2014

(86) PCT No.: PCT/EP2014/052951
§ 371 (c)(1),
(2) Date: Jul. 29, 2015

(87) PCT Pub. No.: WO2014/125088
PCT Pub. Date: Aug. 21, 2014

(65) Prior Publication Data

US 2015/0377528 A1 Dec. 31, 2015

(30) Foreign Application Priority Data

Feb. 14, 2013 (SE) ..... 1350173

(51) Int. Cl.
*F25B 39/02* (2006.01)
*F25B 39/04* (2006.01)
(Continued)

(52) U.S. Cl.
CPC ..... *F25B 39/022* (2013.01); *F25B 39/04* (2013.01); *F25B 40/00* (2013.01); *F28D 9/005* (2013.01);
(Continued)

(58) Field of Classification Search
CPC .... F25B 39/022; F25B 39/04; F25B 2400/05; F25B 40/02; F28D 9/0093
See application file for complete search history.

(56) References Cited

U.S. PATENT DOCUMENTS 2,195,228 A * 3/1940 Schwarz ..... F25B 40/02 62/113
4,809,518 A 3/1989 Murayama
(Continued)

FOREIGN PATENT DOCUMENTS

EP 2 174 810 4/2010
EP 2174810 A2 4/2010
(Continued)

OTHER PUBLICATIONS

International Search Report for International Application No. PCT/EP2014/052951 dated May 12, 2014 (2 pages).
(Continued)

*Primary Examiner* — Orlando E Aviles Bosques
(74) *Attorney, Agent, or Firm* — Merchant & Gould P.C.

(57) ABSTRACT

A combined evaporator and condenser (1100) is manufactured from a number of stacked heat exchanger plates (980) provided with a pressed pattern of ridges and grooves for keeping the plates on a distance from one another for creating interplate flow channels (1180, 1200). The evaporator portion (1120, 1150) of the combined evaporator and condenser (1100) has a coolant outlet connectable to an expansion valve (R), and a connection between the condenser portion and the expansion valve (R) runs through the evaporator portion.

10 Claims, 9 Drawing Sheets

(51) Int. Cl.

| | |
|---|---|
| ***F28F 27/02*** | (2006.01) |
| ***F28D 9/00*** | (2006.01) |
| ***F25B 40/00*** | (2006.01) |
| ***F28F 9/02*** | (2006.01) |

(52) U.S. Cl.

CPC ..... *F28D 9/0037* (2013.01); *F28D 9/0093* (2013.01); *F28F 9/026* (2013.01); *F28F 27/02* (2013.01)

(56) References Cited

U.S. PATENT DOCUMENTS

| | | | | |
|---|---|---|---|---|
| 5,505,060 | A | 4/1996 | Kozinski | |
| 9,093,729 | B2 | 7/2015 | Wesner et al. | |
| 2008/0190595 | A1* | 8/2008 | Sjodin | F28D 9/0043 165/167 |
| 2010/0214090 | A1 | 8/2010 | Sartini et al. | |
| 2012/0210746 | A1* | 8/2012 | Kadle | F28D 9/0093 165/166 |
| 2015/0000327 | A1* | 1/2015 | Kakehashi | F28D 9/0093 62/434 |

FOREIGN PATENT DOCUMENTS

| | | | | |
|---|---|---|---|---|
| JP | S52-48153 | U | 4/1977 | |
| JP | H05-149651 | A | 6/1993 | |
| JP | H11-125464 | A | 5/1999 | |
| JP | 2001-012811 | A | 1/2001 | |
| JP | 2011-503509 | A | 1/2011 | |
| JP | 2012-512379 | A | 5/2012 | |
| JP | 2012-512381 | A | 5/2012 | |
| WO | WO 94/14021 | A1 | 6/1994 | |
| WO | WO 97/00415 | | 1/1997 | |
| WO | WO 02/01124 | | 1/2002 | |
| WO | WO 2005/054758 | | 6/2005 | |
| WO | WO 2009/062738 | | 5/2009 | |
| WO | WO 2010/069872 | | 6/2010 | |
| WO | WO 2010/069873 | | 6/2010 | |
| WO | WO 2010/069874 | | 6/2010 | |
| WO | WO-2013114880 | A1 * | 8/2013 | F25D 17/02 |
| WO | WO-2005054758 | A1 * | 6/2015 | F25B 39/02 |

OTHER PUBLICATIONS

Office Action for U.S. Appl. No. 14/764,515, dated Mar. 22, 2018.

* cited by examiner

Prior Art

COMBINED CONDENSOR AND EVAPORATOR

This application is a National Stage Application of PCT/EP 2014/052951, filed 14 Feb. 2014, which claims benefit of Serial No. 1350173-9, filed 14 Feb. 2013 in Sweden and which applications are incorporated herein by reference. To the extent appropriate, a claim of priority is made to each of the above disclosed applications.

FIELD OF THE INVENTION

The present invention relates to a combined evaporator and condenser manufactured from a number of stacked heat exchanger plates provided with a pressed pattern of ridges and grooves for keeping the plates on a distance from one another for creating interplate flow channels, wherein the evaporator portion of the combined evaporator and condenser has a coolant outlet connectable to an expansion valve.

PRIOR ART

Heat pumps for domestic or district heating generally comprises a compressor compressing a gaseous coolant and a condenser wherein compressed gaseous coolant exchanges heat with a heat carrier of e.g. a heating system for a house, such that the coolant condenses. After the coolant has been condensed, it will pass an expansion valve, such that the pressure (and hence the boiling point) of the coolant decreases. The low-pressure coolant then enters an evaporator, wherein the coolant is evaporated under heat exchange with a low-temperature heat carrier, e.g. a brine solution collecting heat from the ground or outside air.

The basic function of the heat pump system as disclosed above is very simple, but in reality, and to achieve the maximum performance, complications will arise.

One example of a phenomenon that will complicate matters is that the temperature differences will differ significantly over time; during winter or heating of heated tap water, it is necessary to condense the coolant at a high temperature, and the brine solution, i.e. the energy carrier used to evaporate the coolant, may be cold, while there might be other temperature levels during springtime and autumn. Usually, adapting the system to different temperatures may be achieved by controlling the pressure differences by controlling the expansion valve and the compressor. It is, however, not possible to vary the heat exchangers, meaning that those must be designed for a "worst case scenario". Generally, bigger is always better, but at some point, the cost of the heat exchangers will be too high.

One major problem with a too small a heat exchanger for condensing gaseous coolant is that not all of the coolant will be condensed as it leaves the condenser. Having uncondensed coolant leaving the condenser is very detrimental to the heat pump process, since uncondensed coolant makes it very hard to control the expansion valve. A common way of circumventing this problem is to provide a suction gas heat exchanger exchanging heat between condensed coolant from the condenser and evaporated coolant leaving the evaporator (generally referred to as "suction gas"). The heat exchanger used for the suction gas heat exchanger is generally very small, it is often sufficient to braze or solder a pipe leading to the expansion valve to the pipe leading the suction gas to the condensor in order to achieve the required heat exchange.

Even if the liquid coolant from the condenser should be totally liquid, it might be advantageous to supercool it far below its boiling point at the pressure upstream the expansion valve. As well known, some the coolant will boil immediately after the expansion valve. This boiling will take its energy from the temperature of the liquid coolant. By supercooling the liquid coolant about to enter the expansion valve, the amount of liquid transforming into gas phase immediately after the expansion valve may be reduced significantly.

This reduction in boiling of coolant immediately downstream the expansion valve has some very positive effects; it is a well known problem that the gas in the coolant increases the volume of the coolant considerably, such that connection pipes of a large diameter must be used and also that the distribution of the coolant in the evaporator can be disturbed by the gaseous content.

It is an object of the invention to provide solutions for supercooling of the liquid coolant entering the expansion valve, such that the above problems concerning distribution and increased pressure drop may be mitigated.

One other problem with a prior art heat pump is the number of components and the corresponding amount of piping necessary. Not only do all pieces of piping increase the risk of failure, there is also a decrease of system efficiency due to increased flow resistance and heat losses.

It is the object of the present invention to provide a heat exchanger allowing for less piping and corresponding higher efficiency, while allowing for supercooling of coolant prior to the coolant passing the expansion valve.

SUMMARY OF THE INVENTION

The invention solves or mitigates the abovementioned problems by providing a combined evaporator and condenser wherein a connection between the evaporator portion and the expansion valve runs through the evaporator portion.

BRIEF DESCRIPTION OF THE DRAWINGS

In the following, embodiments of the invention will be described with reference to the appended drawings, wherein.

DESCRIPTION OF EMBODIMENTS

Figure 1:
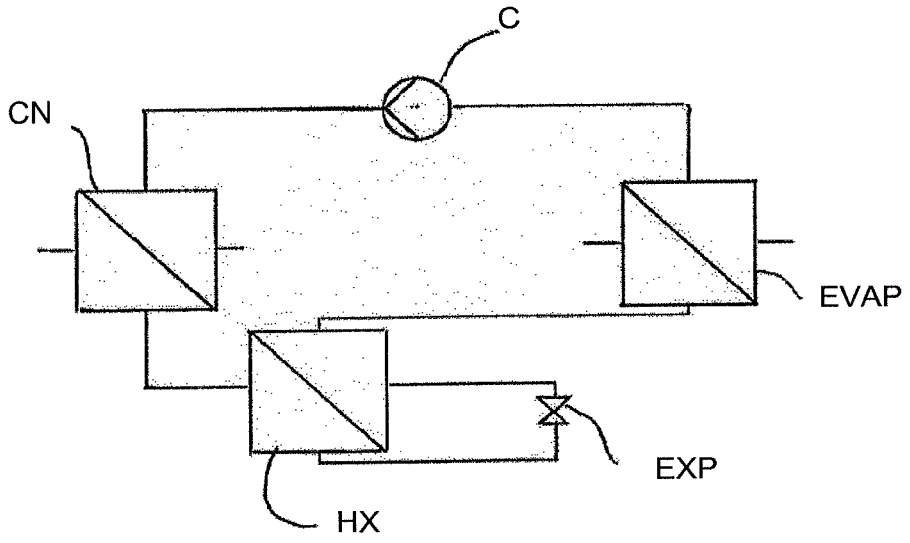
FIG. 1*a* is a schematic view of a heat pump o cooling system according to the prior art.

In FIG. 1, an exemplary heat pump or cooling system utilising an evaporator having a port opening arragement according to the present invention is shown. The system comprises a compressor C, compressing gaseous coolant such that the temperature and pressure of the coolant increases, a condenser CN condensing the gaseous coolant by exchanging heat between the coolant an a high temperature heat carrier, e.g. water for domestic heating, a shortcircuit heat exchanger HX, wherein the temperature of the liquid coolant from the condenser CN decreases by exchanging heat with semi-liquid coolant from an expansion valve EXP. The coolant after the expansion valve will have a low temperature due to partial boiling due to the pressure decrease after the expansion valve. Finally, the semi-liquid coolant will enter an evaporator EVAP, in which the semi-liquid will evaporate by exchanging heat with a low temperature heat carrier, e.g. a brine solution collecting the low temperature heat from e.g. a ground source and/or ambient air.

Typical temperatures for the high temperature heat carrier and the low temperature heat carrier are 50° C. and 0° C., respectively. Hence, the temperature of the liquid coolant leaving the condenser CN will have a temperature exceeding 50° C., and the coolant leaving the expansion valve EXP will have a temperature falling below 0° C.

As could be understood, the gas content of the coolant leaving the expansion valve will be significantly lower than in a heat pump cycle without the shortcircuit heat exchanger HX, since the temperature of the liquid coolant entering the expansion valve EXP will be lower. However, in the configuration of FIG. 1, the gas content of the semi-liquid leaving the short-circuit heat exchanger HX and entering the evaporator EVAP will be identical to the gas content in a semi liquid coolant entering an evaporator in a heat pump system without the short-circuit heat exchanger. Hence, a system according to FIG. 1 will give no effect on the distribution of coolant in the evaporator, which is one of the objectives of the present invention.

Figure 2:
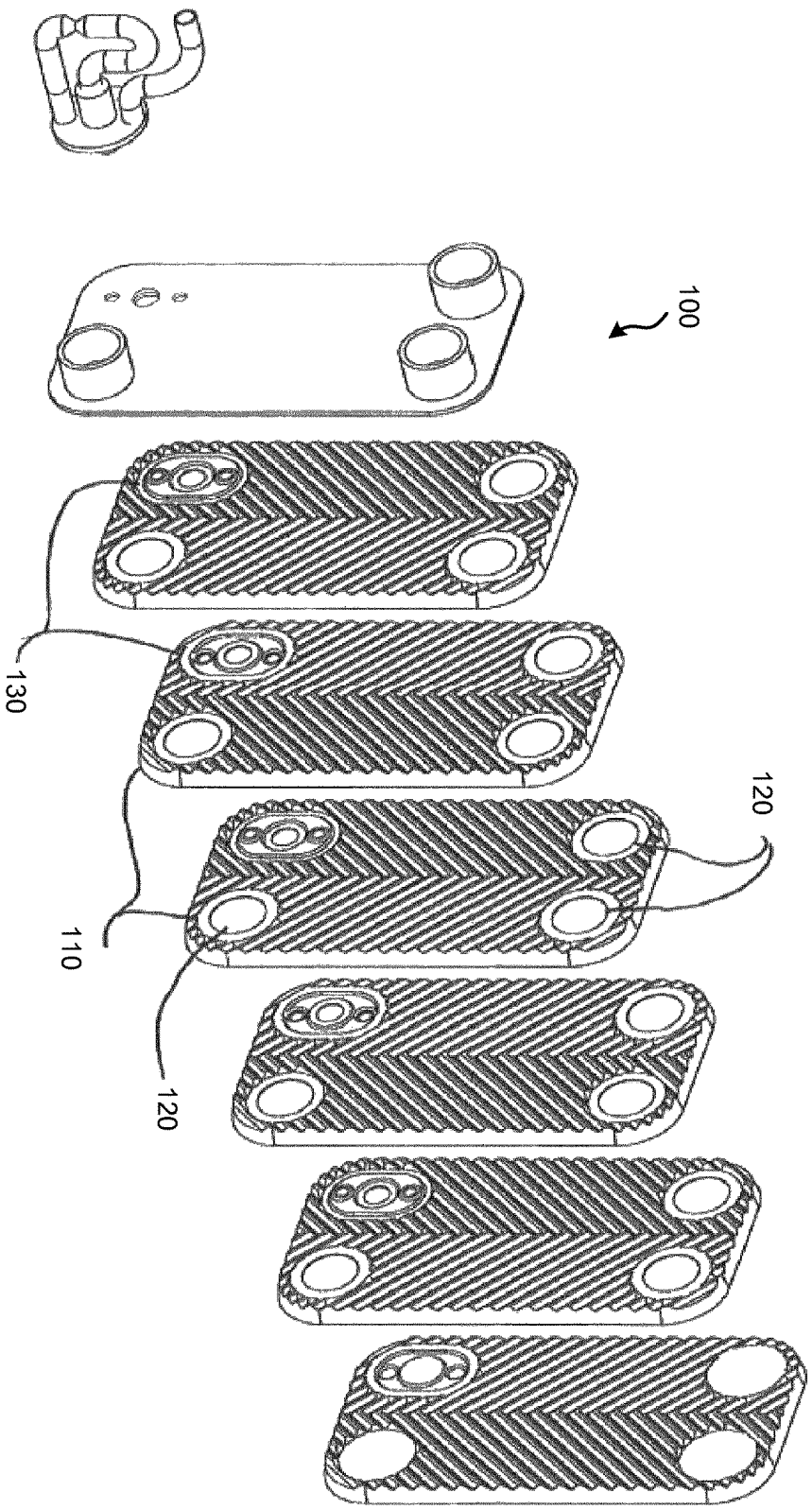
FIG. 2. is an exploded perspective view showing a number of heat exchanger plates comprised in a heat exchanger according to the invention.

With reference to FIG. 2, an evaporator 100 according to one embodiment of the present invention comprises a number of heat exchanger plates 110, each being provided with a pressed pattern of ridges R and grooves G adapted to keep the plates on distance from one another for the formation of interplate flow channels for media to exchange heat. Port areas 120 of the heat exchanger plates 110 are surrounded by plate areas being provided on different heights in order to provide for selective communication between the ports and the interplate flow channels, in a way well known by persons skilled in the art.

An inlet port area 130 comprises an inlet 140 for semi-liquid coolant directly from the expansion valve EXP (meaning that there is no heat exchange of the coolant between the expansion valve and the inlet), and two ports 150, 160 for letting in and letting out liquid coolant from the condenser CN and to the expansion valve EXP, respectively.

In order to form an evaporator, the plates 110 are stacked in a stack, such that the ridges and grooves contact one another and keep the plates on a distance from one another. In a preferred embodiment, the stack of plates is placed in a furnace with brazing material between the plates, such that the plates are brazed together in contact points between neighboring plates.

Figure 3:
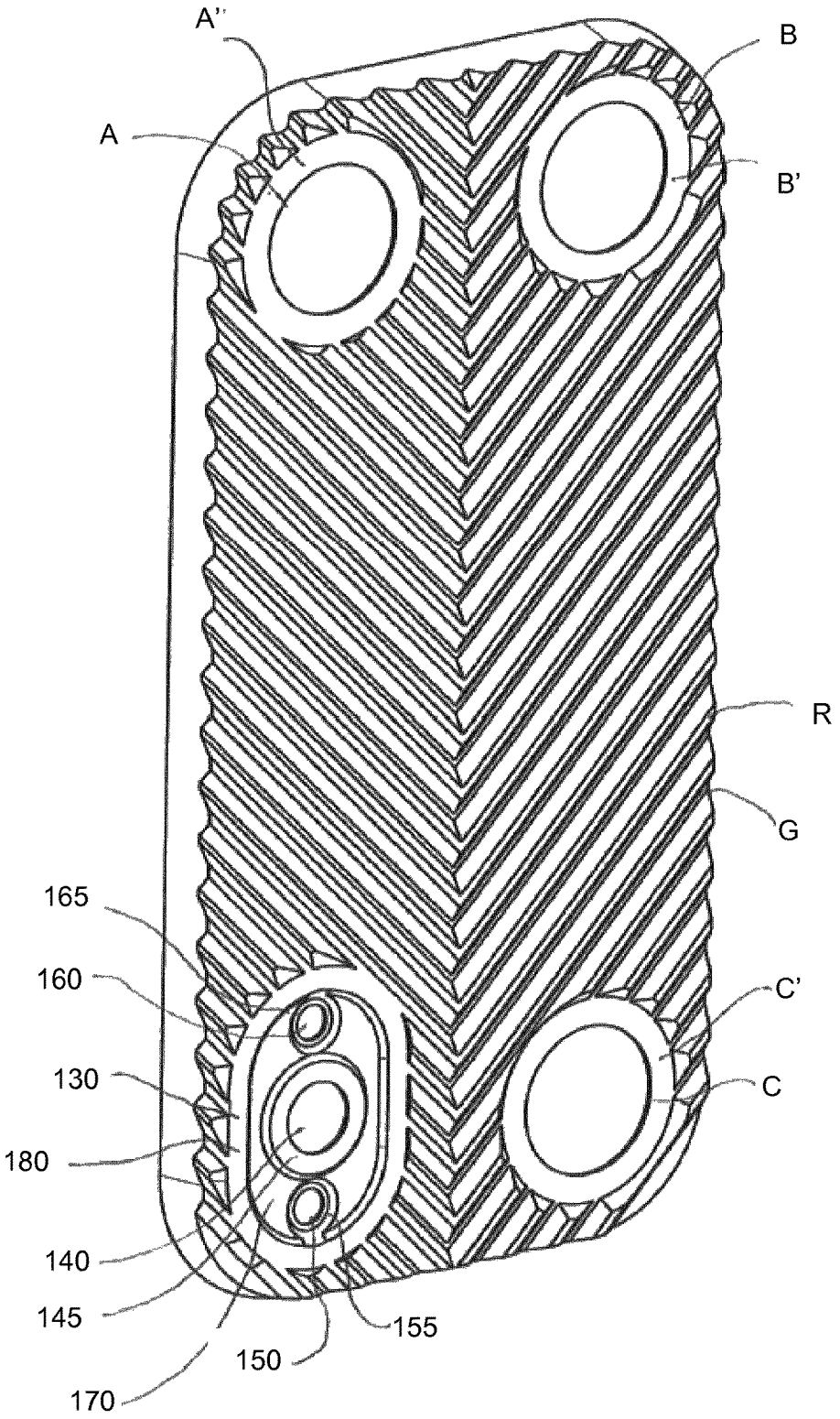
FIG. 3 is a perspective view of one of the heat exchanger plates shown in FIG. 2, in a larger scale.

The port area 130 is more clearly shown in FIG. 3. Here, it is shown that a ringlike area 145 surrounding the port opening 140 is provided on a high level (equal to the level of the ridges R, whereas ringlike areas 155 and 165 surrounding the ports 150, 160, respectively, are provided on a low level (equal to the level of the grooves G). An intermediate area 170, which in the shown embodiment extends around the port opening 140 and its ringlike surrounding area is placed on an intermediate level between the high and low levels. Finally, the intermediate area 170 is surrounded by a blocking area 180, which is provided on the high level, just like the ridges R and the ringlike area 145.

Moreover, openings A, B and C are surrounded by areas A', B' and C', which are provided on high, low and low heights, respectively, are provided near corners of the plate.

When the plate shown in FIG. 3 is placed in a stack, it is neighbored by plates having mirrored heights around the port openings, i.e. such that the ringlike areas 155, 165 are placed on the high level, the ringlike area 145 is placed on a low level and the areas A', B' and C' are placed on low, high and high levels, respectively.

Thus, the following flow channels are formed: Above the plate shown in FIG. 3, there will be a flow channel for e.g. brine solution between the port openings C and B. This flow channel will extend over almost all the area of the plate, but will be blocked from communication with the intermediate area 170 by the blocking area 180. Moreover, there will be a communication between the port openings 150 and 160 over the intermediate area 170.

On the other side of the plate shown in FIG. 3, there will be a communication between the port opening 140 and the port opening A via the interplate flow channel defined by these two plates. This flow channel will extend all over the plate area, including the intermediate area 170.

This embodiment makes it possible to achieve a supercooling of the liquid coolant from the condenser before it enters the expansion valve by letting in hot liquid coolant from the condenser into any of the ports 160 or 150, let supercooled coolant out from the other of the ports 150 or 160, and let semi-liquid coolant from the expansion valve in through the port 140. By this arrangement, there will be a heat exchange between the incoming cool semi liquid coolant from the expansion valve and the incoming hot liquid coolant from the condenser. It is important to notice that this heat exchange takes place after the semi-liquid coolant has been distributed along the height of the stack of heat exchanger plates. Hence, the increased gas content in the semi-liquid coolant from the expansion valve will not disturb the distribution of fluid.

It should be noted that the intermediate area 170 does not have to extend around the port opening 140. In one embodiment of the invention, the intermediate area may run from the long side of the plate and the short side of the plate in a crescent moon fashion, hence partly encircling the port opening.

The evaporators described above may further be equipped with any known means for improving the distribution of semiliquid coolant.

The evaporator according to the above also makes it possible to use a novel heat pump system.

In a prior art system, all, or virtually all, of the pressure drop between the condenser and the evaporator takes place over the expansion valve, which usually may be controlled for adapting the system to various temperature and heating requirements. As mentioned above, it is possible to supercool the liquid coolant from the condenser such that considerably less coolant vaporizes immediately after the expansion valve. However, this benefit is counteracted in the prior art systems due to the temperature rise of the semi liquid coolant from the expansion valve in the supercooler HX, which temperature rise will create gas phase coolant after the supercooler. Consequently, no distribution benefits will be earned according to the prior art solution.

In a system using the evaporator according to the embodiment of FIGS. 2 and 3, it is possible to further improve the distribution by providing a two-step expansion (or, in an ideal case, a first controllable pressure reducing step over the expansion valve and a second expansion step over the distribution pipe).

This system will be explained below:

Imagine a distribution pipe according to e.g. EP08849927.2, which is a distribution pipe comprising an elongate pipe provided with a multitude of small holes aligned with the plate interspaces into which it is desired to feed coolant to be evaporated, wherein the small holes have such a dimension that they will give a sufficient pressure drop in operating conditions of a maximum mass flow and minimal temperature difference between the temperature of the condenser and the temperature of the evaporator. In such an operating condition, there will be liquid only entering the distribution pipe, since the expansion valve will be completely open, and the expansion, after which there will be some gas in the liquid, will take place after the coolant has been properly distributed over the length of the distribution pipe.

It is of course desired to have a system where the pressure drop between the condenser and the evaporator can be controlled, and this can be achieved by putting an ordinary expansion valve upstream the distribution pipe, and here, one of the most important advantages with the present invention compared to the prior art solution can be found: The supercooling between the liquid entering the expansion valve and the liquid leaving the distribution pipe takes place after the distribution pipe has distributed the coolant along the length of the distribution pipe. Hence, the increase of gas phase coolant will not disturb the distribution. In the prior art solution according to FIG. 1, there will be just as much gas being fed into the distribution pipe as it would have been without heat exchange between the coolant form the condenser ad the coolant from the expansion valve, since the reduction of gas in the coolant from the expansion valve will be counteracted by the increase of gas in the coolant entering the heat exchanger from the expansion valve.

Moreover, there will be a stability benefit not attainable by the prior art systems: imagine a situation where it is desired to have a larger pressure drop between the condenser and the evaporator. This can be achieved by controlling the expansion valve such that a partial pressure drop takes place over the expansion valve. Without supercooling, or with supercooling in a supercooler HX according to FIG. 1, reducing the pressure over the expansion valve will cause large amounts of gaseous coolant entering the distribution pipe. As well known, a certain mass flow of gas over a restriction (in this case the holes along the length of the distribution pipe) gives a much larger pressure drop than an equal mass flow of liquid flowing over the same restriction. Consequently, such a system utilized on a prior art system will be very difficult to control.

If used in conjunction with an evaporator according to FIGS. 2 and 3, however, this problem is significantly mitigated: Due to the supercooling AND the fact that the heat exchange between the liquid coolant to the expansion valve and the liquid after the pressure drop in the expansion valve and in the distribution pipe, there will be significantly less gas phase coolant in the distribution pipe, hence increasing the controllability of the system. If the difference between the desired pressure drops and mass flows are sufficiently small, it might even be possible to create a system always working with liquid only in the distribution pipe.

In another embodiment of the invention, shown in FIGS. 4*a* to 4*c* and FIGS. 5*a* and 5*b*, heat exchange between the liquid coolant from the condenser and coolant having a low pressure and consequently low temperature takes place in a tube placed near a distribution pipe according to what has been disclosed above.

Figure 4A:
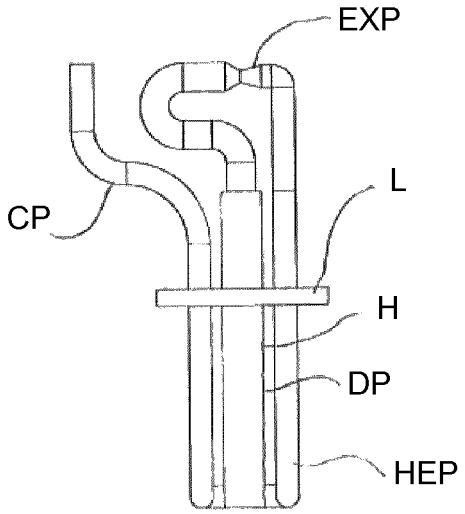
FIG. 4*a* is a plan view of a port arrangement according to the present invention.

With reference to FIG. 4*a*, a port opening arrangement including a distribution pipe DP having a multitude of holes H, a connection pipe CP, a lid L, a heat exchanging pipe HEP and an expansion valve EXP is shown in a side view. The same arrangement is shown in two perspective views in FIGS. 4*b* and 4*c*, where the design of the arrangement is more clearly shown. As can be seen in these figures, the connection pipe runs through the lid L, to a looping configuration LC, which is configured such that it turns the distribution pipe DP 180 degrees, such that the distribution pipe can extend through the lid L once more. After passing the lid, it reaches the expansion valve, makes another sharp U-turn, whereupon the distribution pipe runs through the lid L.

Figure 4B:
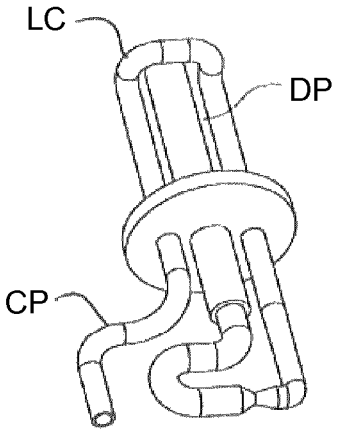
FIGS. 4*b* and 4*c* are perspective views of the port arrangement of FIG. 4*a;*
Figure 4C:
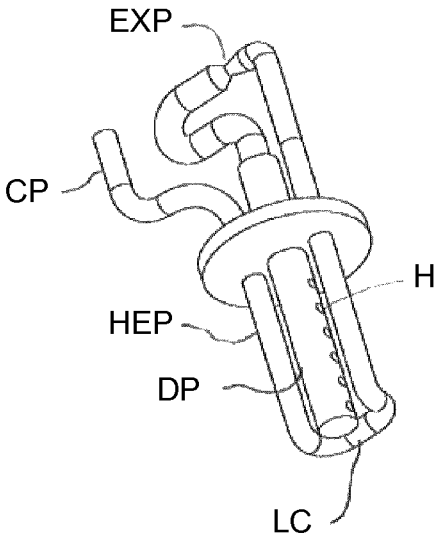
Figure 5A:
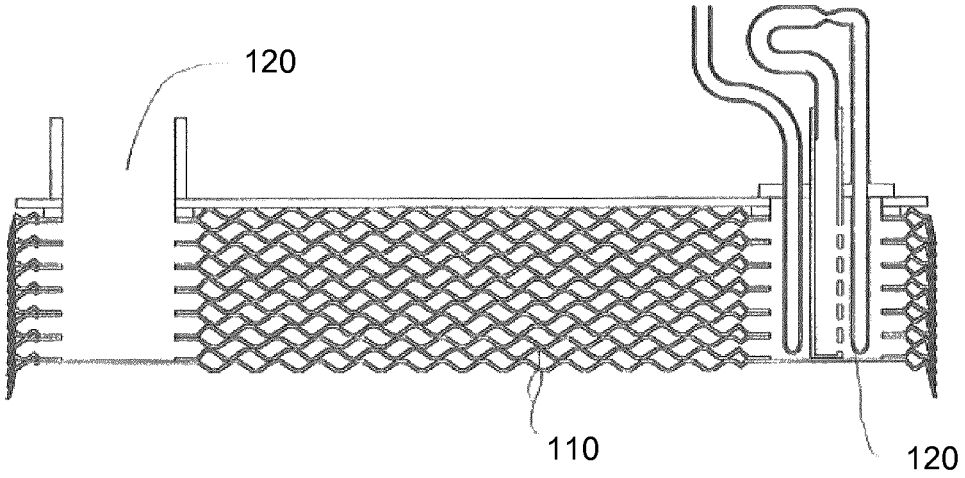
FIG. 5*a* is a section view of a heat exchanger having a port arrangement according to FIGS. 4*a*-4*c*, taken along the line A-A of FIG. 5*b:*
Figure 5B:
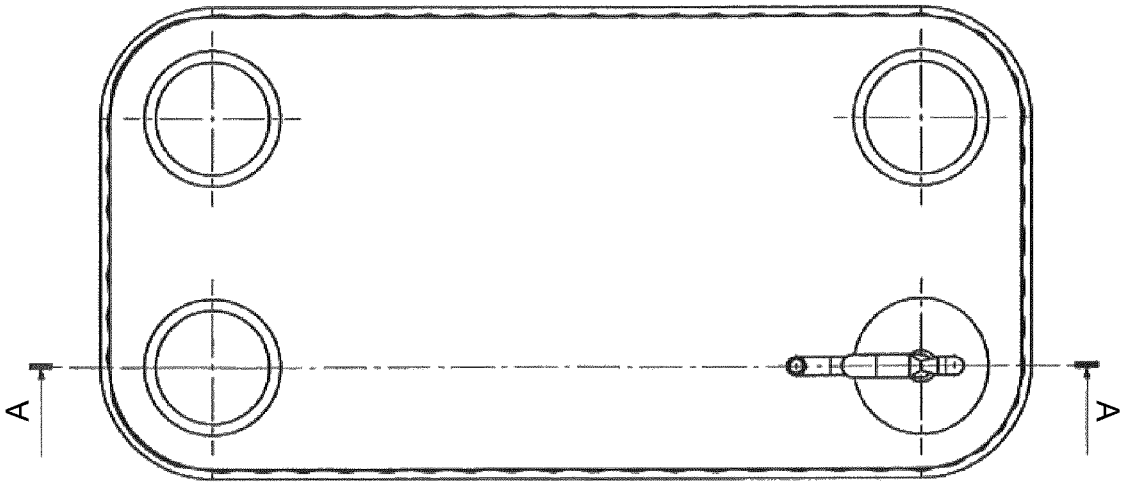
FIG. 5*b* is a plan view of a the heat exchanger of FIG. 5*a;*

During use, the port opening arrangement according to FIGS. 4*a*-4*c* is inserted into a heat exchanger of a known type, such as disclosed in FIGS. 5*a* and 5*b*. FIG. 5*a* is a section view of a plate heat exchanger, along the line A-A of FIG. 5*b* and includes the port openings 120 and heat exchanger plates 110.

The port opening arrangement according to the above may be fastened to the heat exchanger as a retrofit, but it is preferred to provide the port opening arrangement to the heat exchanger during the manufacturing. As mentioned above, a brazed plate heat exchanger is manufactured by placing heat exchanger plates provided with a pressed pattern of ridges and grooves in a stack, wherein a brazing material having a lower melting point than the material in the heat exchanger plates, place the stack in a furnace, heating the temperature of the furnace such that the brazing material melts and thereafter allow the heat exchanger plates to cool down. After the cooling down, the brazing material has solidified and will keep the plates together in contact points provided by the pressed patterns of the heat exchanger plates. The port opening arrangement can be brazed to the heat exchanger during this brazing process, but it can also be fastened to the heat exchanger after the heat exchanger has been brazed, e.g. by welding the lid to a top plate of the heat exchanger.

As could be understood, the distribution pipe of a port opening arrangement according to the above must have a distribution pipe having a smaller diameter than a distribution pipe of a prior art system, i.e. where no heat exchange is provided for in the port opening. This could potentially lead to a less favorable distribution due to pressure drop from the inlet of the distribution pipe to the end thereof, but this problem is mitigated by the aforementioned fact that the volume of the coolant entering the distribution pipe will be significantly smaller as compared to prior art solutions, i.e. where there is no cooling of the liquid coolant prior to entering the expansion valve.

As could be understood, there will be less heat exchange and hence higher temperature of the liquid coolant entering the expansion valve with the port opening arrangement compared to the heat exchanger with the pressed flow channels shown in FIG. 2. It is however possible to increase the heat exchanging of the port opening arrangement by leading the heat exchanging pipe back and forth along the distribution pipe four, six or even eight times without significantly increasing the diameter of the necessary port opening.

The port opening arrangement according to the above also makes it possible to manufacture a combined evaporator and condenser having a pipe leading from the condenser to the expansion valve through the port area of the evaporator, such that a heat exchange takes place between the coolant from the evaporator and the coolant after leaving the expansion valve.

Figure 6:
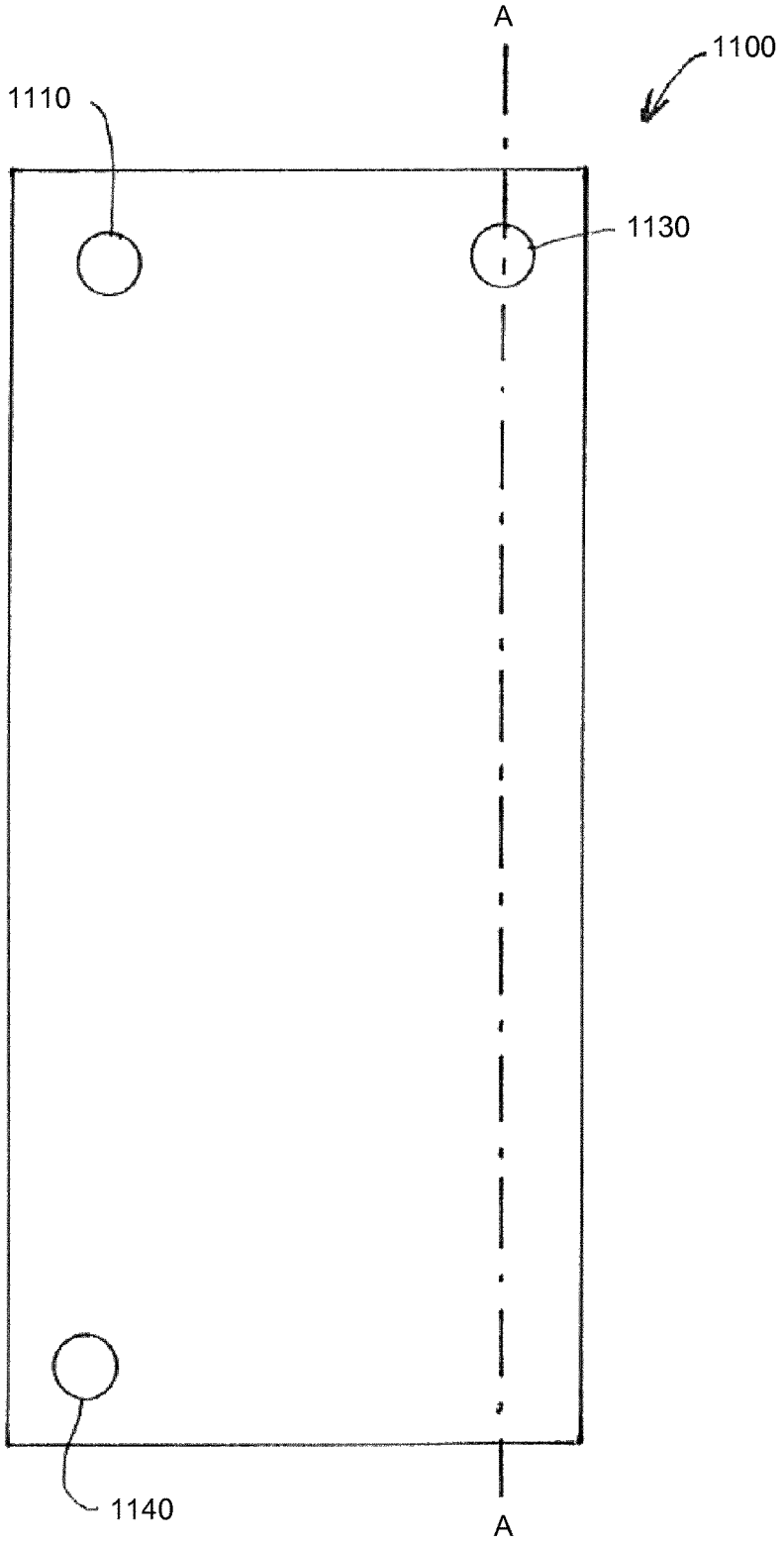
FIG. 6 is a schematic plan view of a condenser side of a combined evaporator and condenser utilizing a heat exchange in the port opening of the evaporator.

In FIG. 6, a front plate of a combined condenser and evaporator 1100 according to the present invention is shown. The combined condenser and evaporator 1100 is manufactured from a number of heat exchanger plates provided with a pressed pattern of ridges and grooves adapted to keep neighboring plates on a distance from one another under formation of interplate flow channels. Port openings are provided in the plates in order to allow for a fluid flow from outside the combined condenser and evaporator 1100 to the interplate flow channels. By providing plate areas around port openings on different heights, it is possible to achieve a selected communication, i.e. such that a port opening only communicates with some of the interplate flow channels. The edges of each plate are provided with skirts adapted to overlap with skirts of a neighboring plates to form a seal for the interplate flow channels. In order to keep the plates together and hermetically seal the heat exchanger flow channels, the plates are brazed in a furnace, i.e. heated such that a brazing material having a lower melting temperature than the plate material melts and joins the plates after cooling of This technique for manufacturing brazed plate heat exchangers is well known by persons skilled in the art, and will hence not be further discussed.

Figure 8:
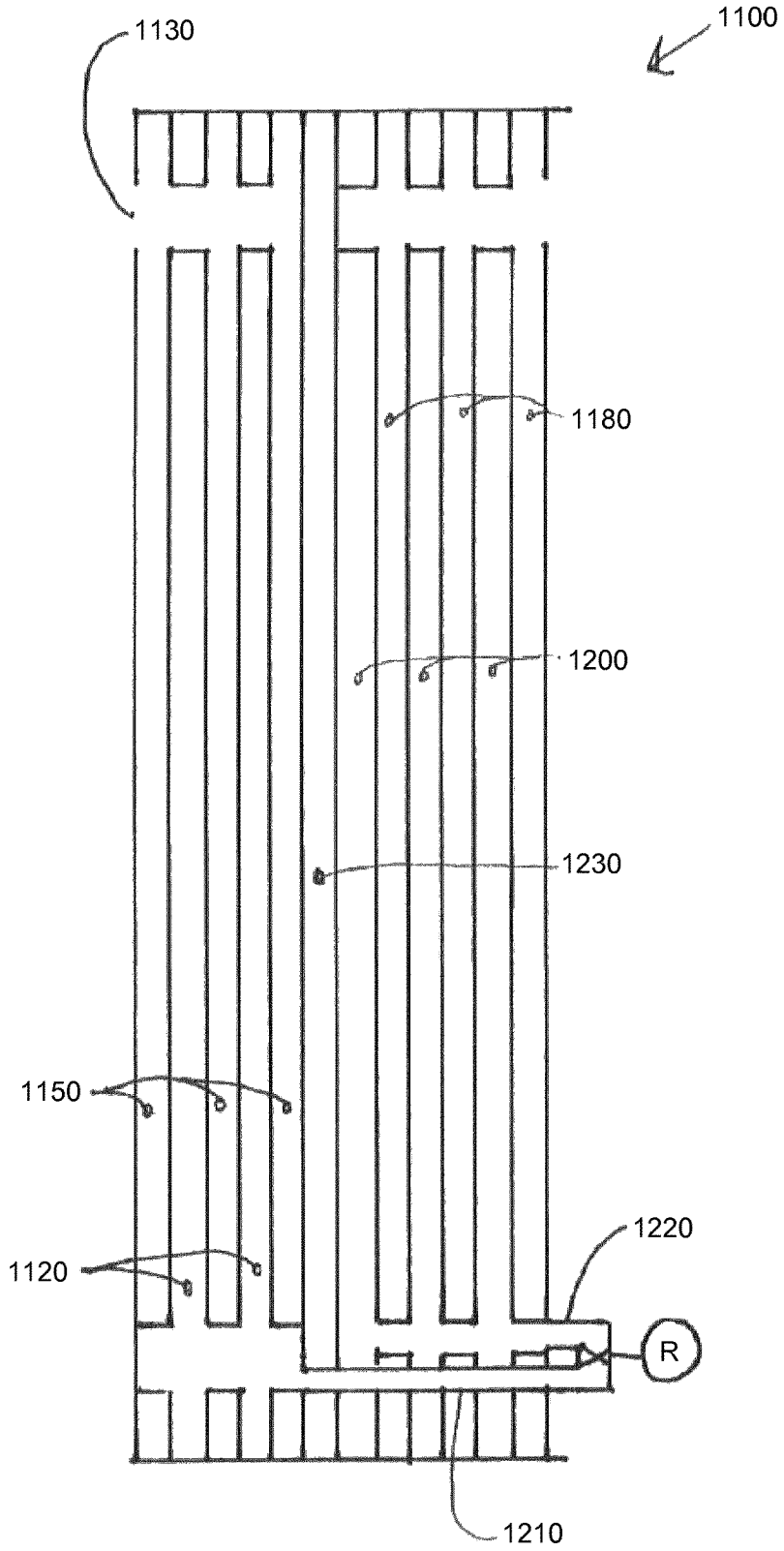
FIG. 8 is a section view of the combined evaporator shown in FIGS. 6 and 7, taken along the line A-A of these figures.

With reference to FIG. 6, a condenser side of the combined condenser and evaporator 1100 comprises a coolant opening 1110 communicating with a first set of interplate flow channels 1200 (see FIG. 8) and first 1130 and second 1140 heat carrier openings, both of which communicating with a second set of interplate flow channels 1150 (see FIG. 8). In use, the first and second heat carrier openings are preferably connected to a heating system of a building, and the coolant opening is connected to a high pressure side of the compressor.

Figure 7:
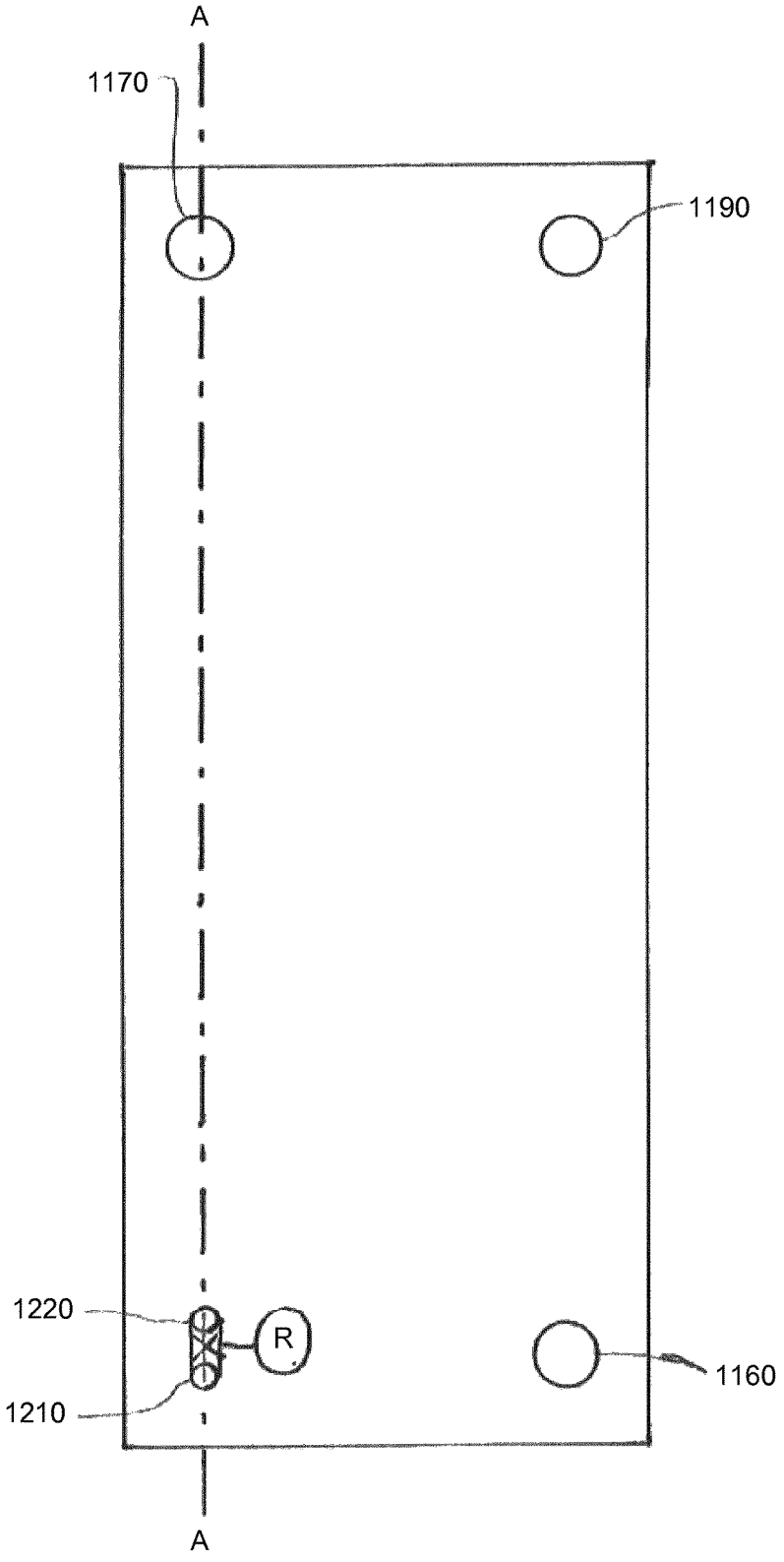
FIG. 7 is a schematic plan view of an evaporator side of a combined evaporator and condenser utilizing a heat exchange in the port opening of the evaporator.

With reference to FIG. 7, an evaporator side of the combined condenser and evaporator 1100 comprises first 1160 and second 1170 brine openings, both of which communicating with a third set of interplate flow channels and a coolant outlet 1190, which communicates with fourth set of interplate flow channels 1200. Moreover, first 1210 and second 1220 coolant connections are shown, the function of which being described later, with reference to FIG. 7. During use, the first and second brine openings are connected to a brine system collecting low temperature heat from a low temperature heat source, the coolant outlet is connected to the low pressure side of the compressor, and the first and second coolant outlets are connected to one another via an expansion valve R.

FIG. 8 shows a section taken along the line A-A of FIGS. 6 and 7. Here, it is clearly shown that the interplate flow channels 1120 communicates with the pipe 1210, which leads from the interplate flow channels 1120 to the expansion valve R through the evaporator portion of the combined condenser and evaporator 1100, which comprises the interplate flow channels 1180 and 1200. At least one "blind" channel 1230 may be provided between the condenser portion and the evaporator portion. The purpose of this channel is to thermally insulate the condenser portion and the evaporator portion from one another, and the insulating properties are improved if the blind channel is arranged such that a vacuum from the brazing process (which often is performed in a furnace under vacuum) is retained in the blind channel.

In the embodiment of FIG. 8, the skirts surrounding the heat exchanger plates are all pointing in the same direction (toward the right), but in one embodiment of the invention, the skirts may point in one direction for the plates in the evaporator portion and in the other direction for the plates in the condenser portion.

When it comes to the pipe 1210, this pipe may be of any design. In one embodiment of the invention, the pipe 1210 is formed by providing port openings in the plates forming the interplate flow channels 1180, 1200 with skirts arranged to overlap one another, similar to how the edge portions of the plates are provided. Port openings of this type are described in WIPO Publications WO 2010/069874, WO 2010/069873, and WO 2010/069872.

It is also possible to provide an ordinary pipe between the interplate flow channels 1200 to the expansion valve R through the evaporator portion.

In still another embodiment of the invention, which is useful if the system configuration makes it unnecessary with supercooling, it is possible to combine the two pipe configurations disclosed above, such that an ordinary pipe is located within a larger pipe made up from overlapping skirts. Just like in the case with the blind channel 1230, it is possible to design the pipes such that a vacuum is formed between the pipe made from the overlapping skirts and the ordinary pipe. By providing a vacuum between the pipes, there will be very good thermal insulation between the inner pipe (which leads liquid coolant from the interplate flow channels 1120 to the expansion valve R) and the evaporator (where low temperature semi-liquid coolant is present).

The pipe 1220 communicates with the interplate flow channels 1200, and provides these channels with low pressure semi-liquid coolant to be evaporated.

In some embodiments, it might be desired with a distribution pipe ensuring an even distribution of coolant into the interplate flow channels 1200; this may be achieved by a distribution pipe provided with small holes along its length, such that the holes will be aligned with the interplate flow channels 1200. An example of a distribution pipe design that could be used is disclosed in WIPO Publication WO 2009/062738. In another embodiment, the distribution pipe is made up from overlapping skirts as disclosed above with reference to the WIPO Publications WO 2010/069874, WO 2010/069873, and WO 2010/069872, but provided with openings.

Above, the invention has been described with reference to specific embodiments; however, the invention is not limited to those embodiments, but can be varied within wide limits without falling outside the scope of the invention such as defined by the appended claims.

For example, the placement of the port openings for the respective media flowing in the interplate flow channels may be varied. According to the figures, all port openings are placed such that there is a crossflow configuration of the media, but this is not necessary nor possible in some cases. If identical plates are used for the condenser portion and evaporator portions of the combined condenser and evaporator 1100, it is for example necessary that there will be a parallel flow of the media exchanging heat. Such heat exchanger plates are necessarily provided with a herringbone pattern, and every other plate is turned 180 degrees in its plane compared to its neighboring plates.

Figure 9:
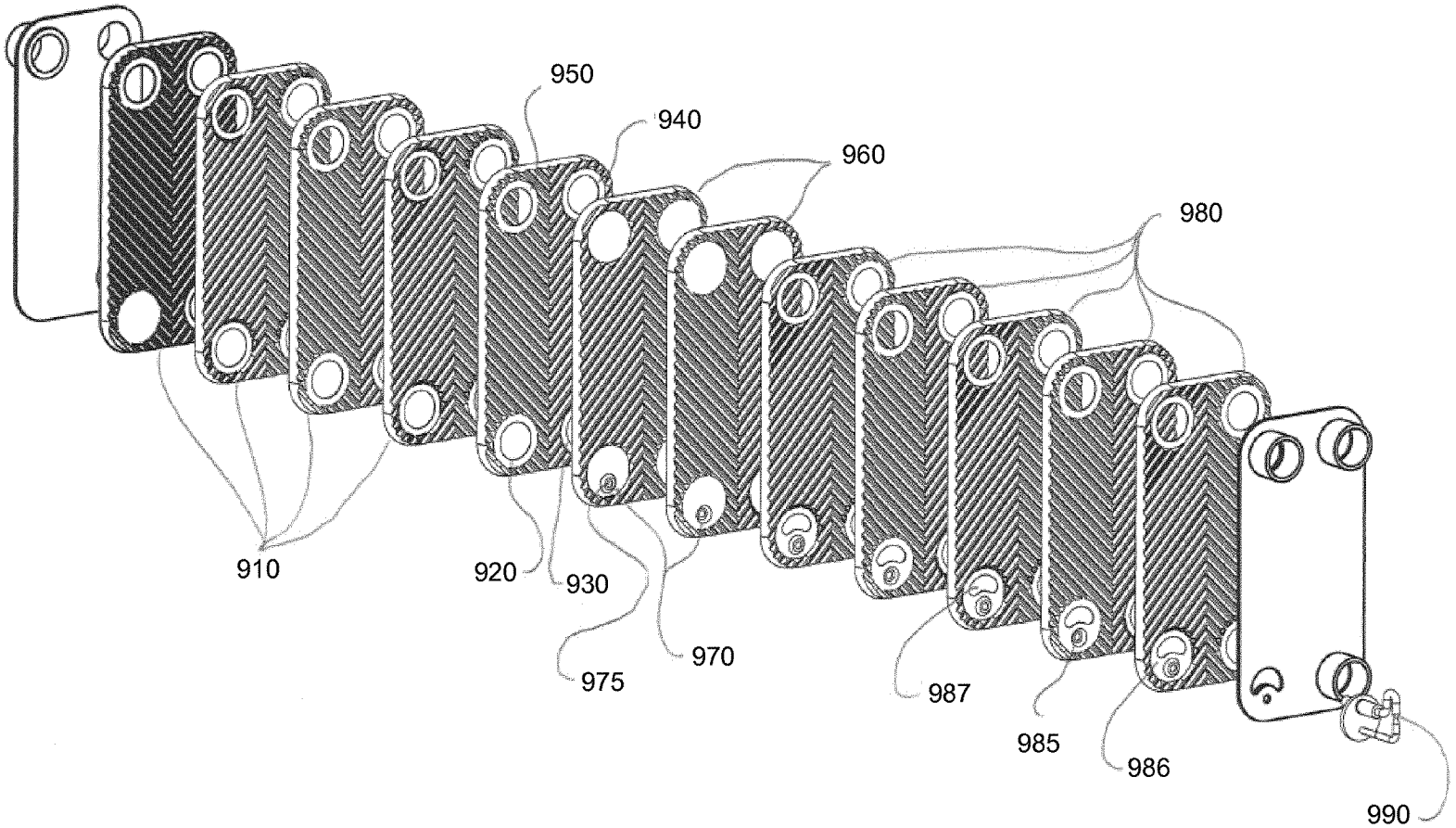
FIG. 9 is an exploded perspective view of a number of heat exchanger plates comprised in a combined condenser and evaporator according to onte embodiment of the present invention.

Still another embodiment of the invention is shown in FIG. 9. This embodiment concerns a combined evaporator and condenser an comprises a number of condenser plates 910, each being provided with a pressed pattern of ridges and grooves for keeping the plates on a distance from one another under formation of interplate flow channels for media to exchange heat. Moreover, the condenser plates comprise four port openings 920, 930, 940 and 950 for selective communication between the interplate flow channels and the port openings. In the present case, the port opening 920 is an outlet opening for condensed coolant, the port opening 930 is an inlet for a high temperature heat carrier and the port openings 940 and 950 are inlets for gaseous coolant and outlet for high temperature heat carrier.

Two division plates 960 are provided between the condenser plates and an evaporator to be described below. The division plates 960 are similar to the condenser plates 920-950, but the port openings are not present on those plates, with an exception for small transfer channels 970 for condensed coolant. The transfer channels 970 have a frustum shape, wherein an upper area of the frustum is portly removed, such that an opening 975 is formed. The transfer channels on neighboring plates are provided in different directions; as can be seen in FIG. 9, the left transfer channel points to the right side, whereas the right transfer channel points to the left. When the distribution plates 960 are placed next to one another to form the stack of plates forming the combined condenser and evaporator according to this embodiment, the two transfer channels of the neighboring plates will contact one another and hence form a pipe having a serrated cross section.

The combined condenser and evaporator according to this embodiment also comprises a number of evaporator plates 980. The evaporator plates are practically identical to the condenser plates, except for one port opening 985, that differs significantly from the other port openings:

The port opening 985 comprises a base surface 986, which is arranged on alternating levels for neighboring plates; either on a low level or a high level. An opening 987 is provided in the base surface. Moreover, the base surface comprises transfer channels 970, and the transfer channels on the base surfaces point downwards on bases surfaces being provided on a high level and upwards on base surfaces provided on a low level.

When placed in the stack, the transfer cannels of neighboring plates will form a continuation of the pipe formed by the transfer channels on the intermediate plate. This pipe will extend through the entire stack of evaporator plates 980, whereas the base surfaces will form a selective communication between the openings 987 and interplate flow channels between the evaporator plates (the interplate channels between the evaporator plates are formed in the same fashion as the interplate channels in the condenser).

In use, liquid coolant from the condenser will flow through the transfer pipe through the stacked evaporator plates to an expansion valve 990, in which the pressure and the temperature of the coolant will be reduced. The low pressure, low temperature coolant will thereafter enter the openings 987, which as mentioned is in selective communication with interplate flow channels. The coolant will exchange heat with a fluid from a low temperature heat source and leave the evaporator fully vaporized, e.g. through an opening being placed on an opposite side of the evaporator. The heat exchanging function in an evaporator is well known by persons skilled in the art, and will hence not be more thoroughly described.

Just like in the previous embodiments, it is possible to provide a distribution pipe ensuring a proper distribution of coolant into the interplate channels in the openings 987.

Dimension and Materials.

The combined condenser and evaporator 1100 may be manufactured by any number of plates, but usually, more than two interplate flow channels of each type are provided. The size of the plates may be from 50 to 250 mm wide and from 100 to 500 mm high.

One preferred material for the plates is stainless steel, and the brazing material may be copper. The plates may have a thickness of 0.1 to 1 mm.

If the desired pressure during use is high, end plates may be provided to strengthen the combined condenser and evaporator 1100. Such end plates may be provided with a pressed pattern similar or identical to the plates limiting the interplate flow channels. Openings suitable for the purpose may also be provided in the end plates.

The invention claimed is:

1. A combined evaporator and condenser comprising:

a plurality of stacked heat exchanger plates provided with a pressed pattern of ridges and grooves for keeping the plates on a distance from one another;

wherein a first group of consecutive stacked plates of said heat exchanger plates define interplate flow channels between immediately adjacent plates of said first group of plates, defining an evaporator portion of the combined evaporator and condenser;

wherein a second group of consecutive stacked plates of said heat exchanger plates define interplate flow channels between immediately adjacent plates of said second group of plates, defining a condenser portion of the combined evaporator and condenser;

a pair of consecutive stacked plates of said heat exchanger plates defining a blind channel, wherein the blind channel is located between the condenser portion and the evaporator portion for thermally insulating the condenser portion and the evaporator portion;

wherein the evaporator portion has a coolant outlet connectable to an expansion valve;

wherein a connection between the condenser portion and the expansion valve comprises a pipe that extends sequentially from the outlet of the condenser portion, through the blind channel, through the evaporator portion, and through an outermost plate of the evaporator portion where the pipe is connected to the expansion valve.

2. The combined evaporator and condenser according to claim 1, further comprising port openings provided in the first and second groups of plates in order to allow for a fluid flow from outside the combined condenser and evaporator to the interplate flow channels.

3. The combined evaporator and condenser according to claim 1, wherein edges of each plate are provided with skirts adapted to overlap with skirts of a neighboring plate of the plurality of stacked heat exchanger plates to form a seal for the interplate flow channels.

4. The combined evaporator and condenser according to claim 1, wherein an evaporator side of the evaporator portion of the combined condenser and evaporator comprises first and second brine openings.

5. The combined evaporator and condenser according to claim 1, wherein interplate flow channels of the condenser portion communicate with the expansion valve via the pipe running through the evaporator portion of the combined condenser and evaporator.

6. The combined evaporator and condenser according to claim 5, wherein the pipe running through the evaporator portion of the combined condenser and evaporator is formed by providing port openings in the plates forming the interplate flow channels and the blind channel, with skirts arranged to overlap one another.

7. The combined evaporator and condenser according to claim 1, wherein the blind channel is provided such that a vacuum from a brazing process is retained in the blind channel.

8. The combined evaporator and condenser according to claim 1, further comprising a distribution pipe ensuring an even distribution of coolant into the interplate flow channels of the evaporator portion.

9. The combined evaporator and condenser according to claim 8, wherein the distribution pipe is provided with small holes along its length, such that the holes will be aligned with the interplate flow channels, of the evaporator portion.

10. The combined evaporator and condenser according to claim 8, wherein the distribution pipe is made up from overlapping skirts.

* * * * *